US005121867A

United States Patent [19]

Aoyama et al.

[11] Patent Number: 5,121,867

[45] Date of Patent: Jun. 16, 1992

[54] PAPER TRANSFERRING APPARATUS FOR AN ELECTROPHOTOGRAPH TYPE PRINTER

[75] Inventors: Hirotomo Aoyama, Morioka; Shingo Furukawa, Hanamaki; Satoshi Kumagai, Iwate, all of Japan

[73] Assignee: Sinko Seisakusho Co., Ltd., Hanamaki, Japan

[21] Appl. No.: 713,017

[22] Filed: Jun. 11, 1991

Related U.S. Application Data

[63] Continuation of Ser. No. 453,864, Dec. 20, 1989, abandoned.

[30] Foreign Application Priority Data

Dec. 23, 1988 [JP] Japan ..... 63-323606

[51] Int. Cl.[5] ..... B65H 20/20

[52] U.S. Cl. ..... 226/101; 400/605; 400/608.1; 400/608.2; 400/625

[58] Field of Search ..... 271/9; 400/605, 607, 400/607.2, 608.1-608.4, 625, 641; 226/101, 102, 226/80, 81, 82, 83, 84, 85, 86

[56] References Cited

U.S. PATENT DOCUMENTS 4,619,388 10/1986 Ono et al. ..... 226/76
4,865,305 9/1989 Momiyama ..... 400/625

FOREIGN PATENT DOCUMENTS 0235633 2/1987 European Pat. Off. .
3707886 9/1988 Fed. Rep. of Germany .
3807807 9/1989 Fed. Rep. of Germany .

*Primary Examiner*—Daniel P. Stodola
*Assistant Examiner*—P. Bowen
*Attorney, Agent, or Firm*—Oblon, Spivak, McClelland, Maier & Neustadt

[57] ABSTRACT

A paper transferring apparatus in an electrophotograph type printer includes rollers for transferring out papers from a hopper and through a transferrinng section to a discharge port, as well as first and second tractors for transferring continuous papers from the inlet port through the transferring section and to the discharge port. A motor provides a common driving source for both the rollers and the tractor. Clutches are provided for selectively connecting and disconnection the rollers and the tractors to the motor as a function of whether a cut paper mode or a continuous paper mode is selected by a control unit.

5 Claims, 4 Drawing Sheets

PAPER TRANSFERRING APPARATUS FOR AN ELECTROPHOTOGRAPH TYPE PRINTER

This application is a continuation of application Ser. No. 07/453,864, filed on Dec. 20, 1989, now abandoned.

BACKGROUND OF THE INVENTION

The present invention relates to a paper transferring apparatus in an electrophotograph type printer. More particularly, it relates to a paper transferring apparatus capable of treating rectangular cut papers (herein below, referred to as cut papers) and a continuous folded paper (herein below, referred to as a continuous paper)..

There has been widely used a high speed line printer as an output apparatus for a computer. Various methods of printing have been practically used for the line printer. For instance, there has been known a dot impact method as a mechanical printing method. On the other hand, there has been known a non-impact method such as an optical printer. Since the optical printer can reduce noises in operation and enable high speed printing, it has been increasingly used in recent years.

FIG. 4 is a side view of a conventional paper transferring apparatus used for a dot impact type printer.

The conventional paper transferring apparatus comprises a platen 112 for printing, a printing head 113 disposed in the vicinity of the platen 112, a cut paper feeding roller 114 and a paper pressing roller 115, both being adapted to feed cut papers 111, and a tractor 117 for feeding a continuous paper 116.

In the conventional paper transferring apparatus, when the cut papers 111 are used, printing and paperfeeding operations for the cut papers are carried out by making the cut paper feeding roller 114 contact with the platen 112 as shown in FIG. 4A.

When the continuous paper 116 is used, the cut paper feeding roller 114 is separated from the platen 112 and the continuous paper is fed by the tractor 117 as shown in FIG. 4B. Thus, the conventional printer can treat the cut papers and the continuous paper.

For the high speed line printer, the continuous paper is mainly used. However, there is a possibility that continuous printing is carried out for the cut papers depending on kinds of information outputted from a computer or the purpose of use of the information. In this case, cut portions 119 are formed in a continuous paper 118 so that each of the cut papers 111 can be held by the cut portions 119. Then, it is possible to carry out continuous printing for the cut papers. The abovementioned method of printing is disclosed in, for instance, Japanese Unexamined Utility Model Application 194544/1985, Japanese Unexamined Utility Model Application 8152/1985 and so on.

On the other hand, a non-impact type high speed printer, for instance, an apparatus for changing information outputted from a computer to a visible image such as characters or figures by utilizing an electrophotograph method, inclusively, uses a continuous paper or a roll paper.

In such electrophotograph type printer, when it is desired that the cut papers and the continuous paper be used, it is necessary to adapt a method as shown in FIG. 5 among various conventional methods since the known electrophotograph type printer requires only the continuous paper. However, when the printing operations are carried out for the cut papers held by the continuous paper, it is required for the continuous paper to have a certain strength, and therefore a relatively thick paper is required for such continuous paper. Further, since the cut portions are needed for the continuous paper, the manufacturing cost becomes high. Furthermore, an additional operation of folding the cut papers to the cut portions of the continuous paper is necessary.

It is an object of the present invention to provide a paper transferring apparatus for a high speed electrophotograph type printer which is capable of treating not only a continuous paper but also cut papers; being manufactured at a low cost, and capable of switching a kind of paper to be used without complicated operations.

According to the present invention, there is provided a paper transferring apparatus for an electrophotograph type printer which comprises an apparatus main body having a side surface where a hopper for receiving cut papers and an inlet port for a continuous paper are provided, and the other surface opposite said side surface where a discharge port for discharging the cut papers and the continuous paper is formed; a cut paper transferring means for transferring the cut papers from the hopper through a transferring section to the discharge port and a continuous paper transferring means for transferring the continuous paper from the inlet port through the transferring section to the discharge port which are independently provided in the apparatus main body and a common driving source for driving both transferring means; the cut paper transferring means having a connection/disconnection means which performs connection and disconnection of the rotational force of the driving means to the cut paper transferring means upon receiving a control signal; the continuous paper transferring means having a first tractor at the inlet port side and a second tractor behind said transferring section, which are connected to the driving source through a power transmission means, and a connection/disconnection means interposed between the power transmission means and the driving source, which performs connection and disconnection of the rotational force of the driving source to the first and second tractors upon receiving a control signal; and a control means which selects cut paper mode or continuous paper mode on the basis of an input signal and which provides the control signal to each of the connection/disconnection means on the basis of a paperfeeding instruction or a printing instruction under a selected mode.

DETAILED DESCRIPTION OF THE PREFERRED EMBODIMENT

Figure 1:
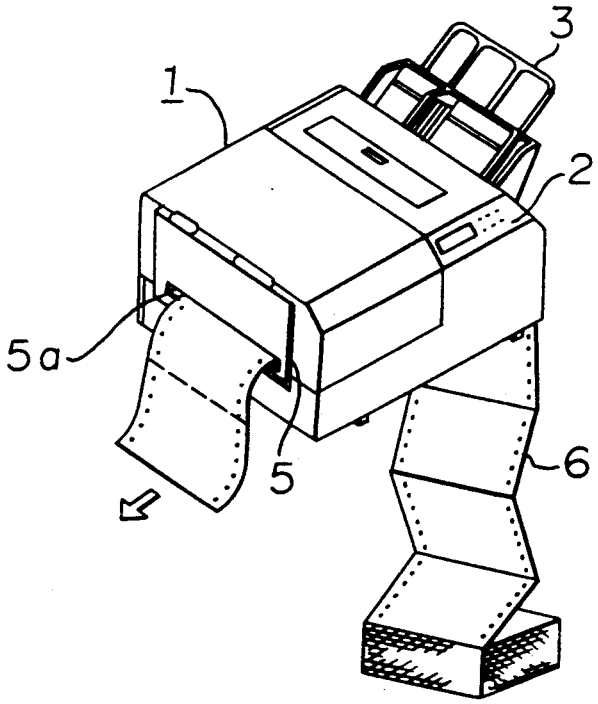
FIG. 1 is a perspective view of an electrophotograph type high speed printer in which an embodiment of the paper transferring apparatus according to the present invention is installed and a continuous paper is used.
Figure 2:
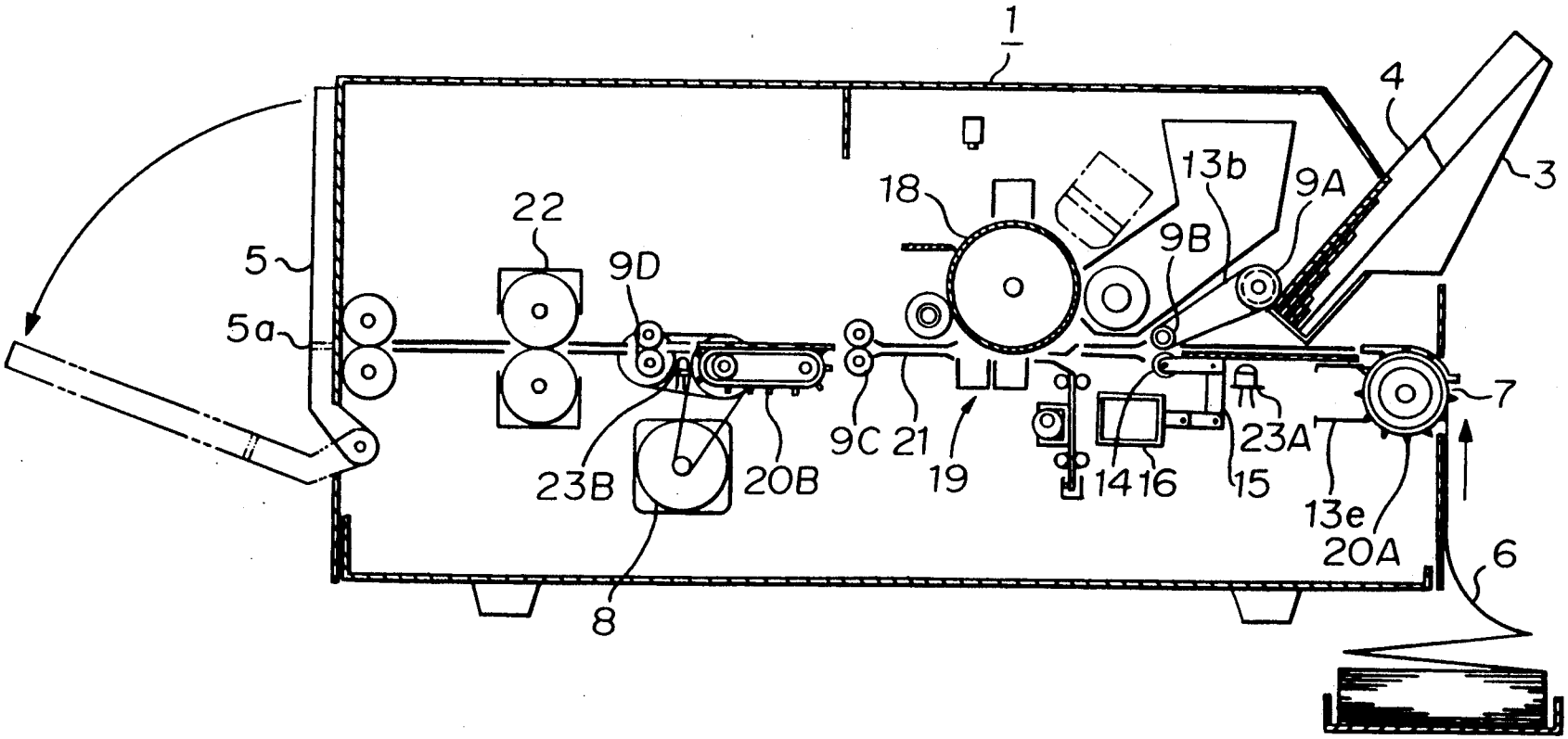
FIG. 2 is a longitudinal cross-sectional view of the interior of the printer as shown in FIG. 1.
Figure 3:
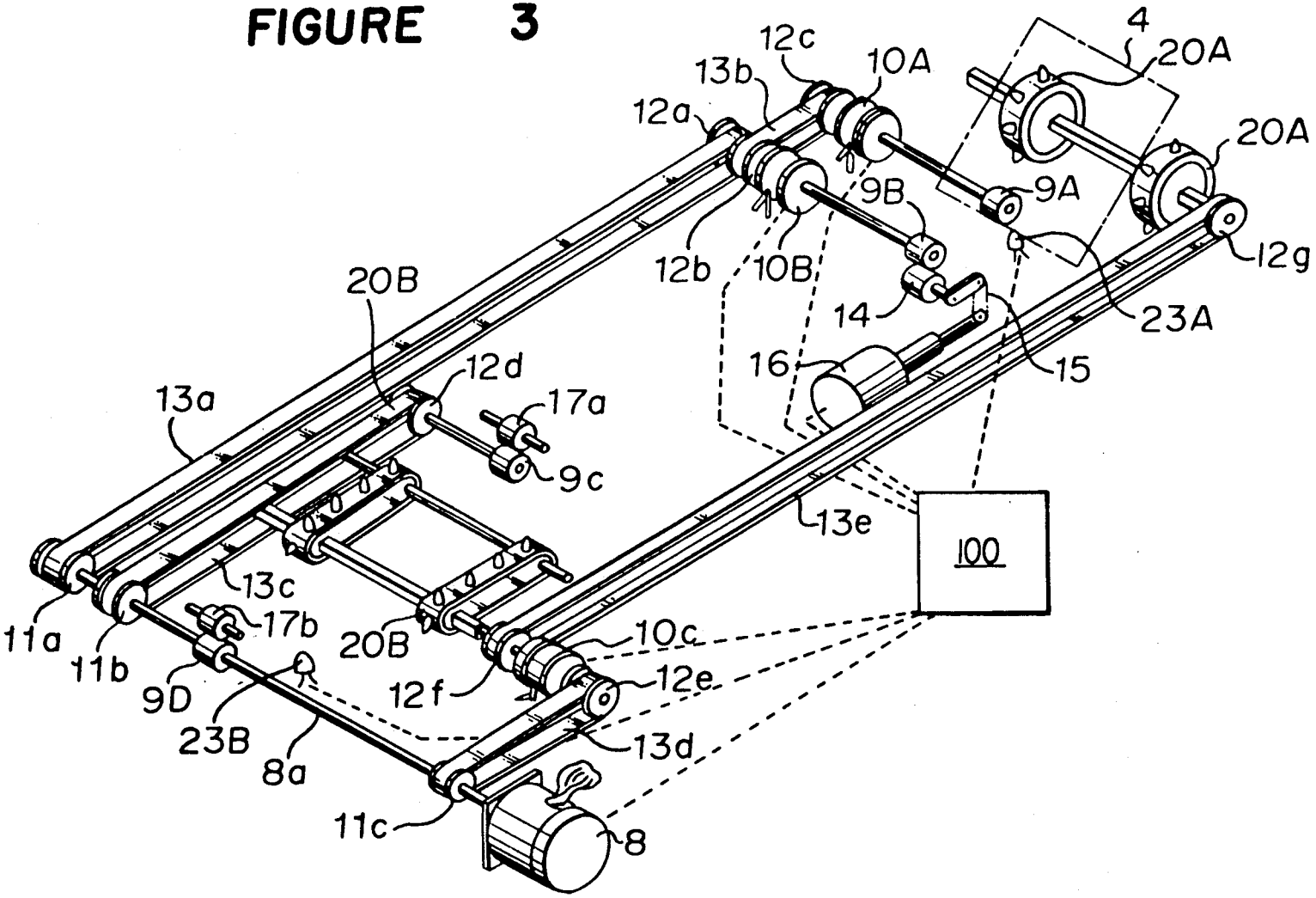
FIG. 3 is a perspective view of an embodiment of the paper transferring apparatus according to the present invention.
Figure 4A:
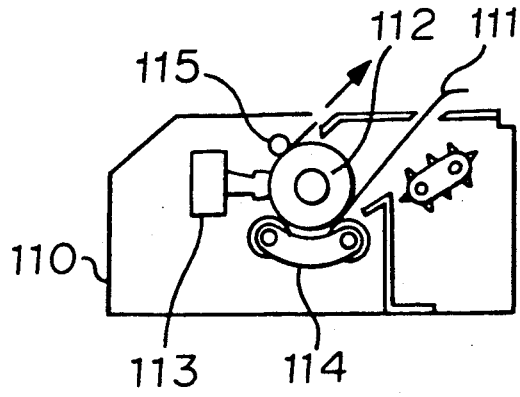
FIGURE 4(A) PRIOR ART
FIGS. 4A and 4B are respectively side views showing a conventional paper transferring apparatus.
Figure 4B:
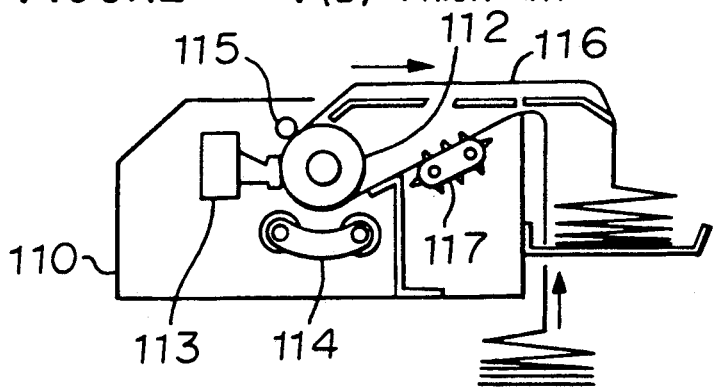
FIGURE 4(B) PRIOR ART
Figure 5:
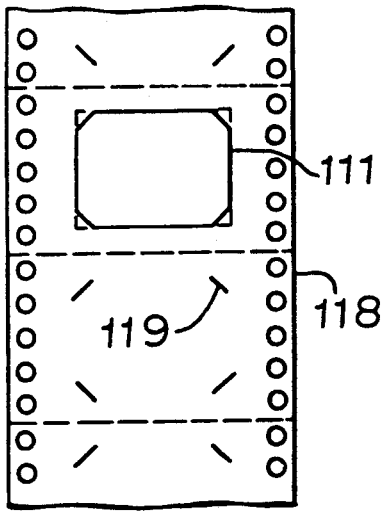
FIGURE 5 PRIOR ART
FIG. 5 is a front view showing an example of a printing method for cut papers by using a conventional line printer.

A preferred embodiment of the paper transferring apparatus according to the present invention will be described with reference to the drawings. In FIGS. 1 through 3, the same reference numerals designate the same or corresponding parts. A reference numeral 1 designates an apparatus main body having at its front surface an operation panel 2 which is provided with a power switch, mode-selecting switches for selecting cut paper mode and continuous paper mode, and so on.

A numeral 3 designates a hopper for receiving cut papers which is provided at a side surface of the apparatus main body 1. The hopper 3 is adapted to receive thereon various types of cut papers 4 depending on the purpose of use. The cut papers in the hopper 3 are transferred into the apparatus main body by a cut paper transferring means which will be described below.

A numeral 5 designates a stacker provided at the opposite side of the hopper. The stacker 5 is so adapted that when the cut papers are used, the stacker is opened by turning it downwardly so that it receives as a paper receiver the cut papers after printing operations as shown in FIG. 2. A numeral 5*a* designates a discharge port in a slit form which is formed in the stacker 5.

A numeral 6 designates a continuous paper. The continuous paper 6 is put into the apparatus main body through an inlet port 7 formed at the lower portion of the hopper 3 and at a side surface of the apparatus main body 1 by means of a continuous paper transferring means which will be described hereinafter.

A numeral 8 designates a driving source for transferring the cut papers 4 or the continuous paper 6 by driving the cut paper transferring means or the continuous paper transferring means. In a preferred embodiment, a pulse motor capable of forwardly rotating and reversely rotating is used.

The construction of the cut paper transferring means will be described. The cut paper transferring means comprises a driving source 8, a paper feeding roller 9A driven by the driving source 8 to deliver the cut papers received in the hopper 3, a feeding roller 9B for feeding the delivered cut papers to a transferring section which will be described hereinbelow, feeding rollers 9C, 9D for feeding the cut papers having passed through the transferring section toward a discharge port 5*a*, a transmission means for transmitting the rotational force of the driving source to each of the rollers 9A-9D and connection/disconnection means 10A, 10B which perform transmission and interruption of the rotational force to the paper feeding roller 9A and the feeding roller 9B.

The transmission means comprises a driving shaft 8*a* connected to the driving source 8 to be rotated, driving pulleys 11*a*, 11*b*, 11*c* attached to the driving shaft 8*a*, driven pulleys 12*a*, 12*b*, 12*c*, 12*d*, and transmission belts 13*a*, 13*b*, 13*c* extended between each pairs of the pulleys 11*a*, 12*a*, the pulleys 12*b*, 12*c* and the pulleys 11*b*, 12*d*.

The paper feeding roller 9A is attached to a rotary shaft for the pulley 12*c*. The feeding roller 9B is attached to a rotary shaft for the pulley 12*b*. The feeding roller 9C is attached to a rotary shaft for the pulley 12*d*. The feeding roller 9D is attached to the driving shaft 8*a*. An electromagnetic clutch 10A which constitutes one connection/disconnection means is attached to the rotary shaft of the pulley 12*c*, another electromagnetic clutch 10B which constitutes another one of the connection/disconnection means is attached to the rotary shaft of the driven pulley 12*a*.

These electromagnetic clutches 10A, 10B are rendered to be either in a state of transmission or interruption by control signals from a control unit 100 which will be described hereinafter, so that either the rotational force of the driving source 8 is transmitted respectively to the paper feeding roller 9A and the feeding roller 9B in the state of transmission, or the rollers 9A, 9B are stopped due to the interruption.

A driven roller 14 is provided at the lower portion of the feeding roller 9B. The driven roller 14 is brought to contact with the feeding roller 9B or is separated from it by the action of a solenoid 16 through a link 15.

Pinch rollers 17*a*, 17*b* are respectively located at the opposite side of the feeding rollers 9C, 9D with respect to a paper transferring plane.

A photosensitive member 18, i.e. a member having sensitiveness to light, and a transferring section 19 for the electrophotograph type printer are located between the feeding roller 9B and the feeding roller 9C.

The paper feeding roller 9A is rotated by a predetermined quantity via the electromagnetic clutch 10A so that the cut papers 4 received in the hopper 3 are delivered one by one to the transferring section 19.

On the other hand, the continuous paper transferring means comprises the above-mentioned driving source 8, a transmission means, a first tractor 20A, a second tractor 20B and a connection/disconnection means 10*c*.

The transmission means is constituted by the driving pulley 11*c* attached to the driving shaft 8*a*, a driven pulley 12*e*, a transmission belt 13*d* extended between the driving pulley 11*c* and the driven pulley 12*e*, driven pulleys 12*f*, 12*g* and a transmission belt 13*e* extended between the driven pulleys 12*f* and 12*g*.

The first tractor 20A is connected to an extension of the rotary shaft of the driven pulley 12*g*, and the second tractor 20B is connected to the rotary shaft of the driven pulley 12*f*.

An electromagnetic clutch 10C as one of the connection/disconnection means is provided between the driving source 8 and the above-mentioned transmission means, e.g. between the rotary shaft of the driven pulley 12*e* and the rotary shaft of the driven pulley 12*f*. The electromagnetic clutch 10C operates in such a manner that the rotational force of the driving source 8 is transmitted to the first tractor 20A and the second tractor 20B in a state of transmission by a control signal from the control means, or the rotational force of the driving source is not transmitted to the first and second tractors to stop them in a state of interruption.

As shown in FIG. 2, the first tractor 20A is positioned near the inlet port 7 for a continuous paper which is formed in the apparatus main body 1, and the second tractor 20B is located at the rear side of the transferring section and between the feeding rollers 9*c* and 9*d*.

In FIG. 2, a reference numeral 21 designates a transferring guide which provides a transferring passage for guiding the cut papers 4 or the continuous paper 6, a numeral 22 designates a fixing device for fixing toner powder to a paper.

A cut paper detecting sensor 23A is provided between the first tractor 20A and the opposing rollers 9B, 14, and a continuous paper detecting sensor 23B is located between the second tractor 20B and the feeding roller 9D.

The cut paper detecting sensor 23A is to detect the front end and the rear end of each of the cut papers 4 delivered from the hopper 3, and the continuous paper detecting sensor 23B is to detect the front end of a continuous paper supplied by means of the first and second tractors 20A, 20B.

There is provided a control means(not shown) which controls each of the electromagnetic clutches 10A, 10B and 10C on the basis of a mode-selecting input signal from the operation panel 2 and a printing instruction signal from a printing controller(not shown). The control means is so adapted that when the cut paper mode is selected, it determines whether or not the continuous paper detecting sensor 23B is in an ON state, and if the sensor 23B is ON, the pulse motor 8 is reversely driven and at same time, the electromagnetic clutch 10C is rendered to be a state of transmission. The state of transmission is continued for a predetermined time by controlling the stepping operations of the pulse motor 8, and upon expiration of the predetermined time, the electromagnetic clutch 10C is rendered to be a state of interruption. Then, the pulse motor 8 is regularly rotated on the basis of an instruction of paper supply from the printing controller and at the same time, the electromagnetic clutch 10A is rendered to be a state of transmission. As soon as the electromagnetic clutch 10A is actuated, the cut papers are delivered one by one from the hopper 3. When the cut paper detecting sensor 23A is turned on by the delivered cut papers, the electromagnetic clutch 10A is rendered to be a state of interruption, and then, the electromagnetic clutch 10B is rendered to be a state of transmission in synchronism with an instruction of printing from the printing controller.

On the other hand, when the continuous paper mode is selected, the pulse motor 8 is regularly rotated, and at the same time, the electromagnetic clutch 10C is rendered to be a state of transmission, whereby the first tractor 20A and the second tractor 20B are rotated in predetermined directions respectively so that the movement of the tractors are controlled.

The operation of the above-mentioned embodiment of the paper transferring apparatus of the present invention will be described.

Description will be made as to a case that the cut paper mode is selected by operating the mode selecting switch on the operation panel 2. In this case, the stacker 5 is previously turned to an open state so that the cut papers subjected to printing operations are received as shown in FIG. 2.

In such case that the cut paper mode is selected, when a continuous paper is in the high speed line printer and the continuous paper is sensed by the continuous paper detecting sensor 23B, the continuous paper transferring means is operated to reversely transfer the continuous paper. Namely, the electromagnetic clutch 10C is rendered to be a state of transmission by a control signal produced in the control means 100, and at the same time, the pulse motor 8 is driven in the direction reverse to the regular direction of rotation of the motor, whereby the first tractor 20A and the second tractor 20B are rotated in the reverse directions. By the actuation of the tractors, the continuous paper is transferred to a predetermined position between the hopper 3 and the first tractor 20A by controlling the stepping operations of the pulse motor 8. At that moment, the electromagnetic clutch 10C is again rendered to be in a state of interruption so that the continuous paper is stopped at a position where the delivering operations for the cut papers from the hopper 3 is not hindered by such operations. The continuous paper 6 is kept without being released from the first tractor 20A.

Following the retraction of the continuous paper under the condition of the selection of the cut paper mode, the cut paper transferring means is actuated. Namely, the control means makes the electromagnetic clutch 10A to be a state of transmission, and at the same time, it makes the pulse motor 8 rotate in the regular direction of rotation. Then, the paper feeding roller 9A is rotated in a predetermined direction through the transmission elements 8*a*, 11*a*, 12*a*, 13*a*, 12*b*, 12*c* and 13*b*. Further, the feeding rollers 9C, 9D are respectively rotated in the predetermined directions by means of the transmission elements 8*a*, 11*b*, 12*d* and 13*c*. When the paper feeding roller 9A is rotated, the delivering operations of the cut papers in the hopper 3 are executed.

A cut paper 4 delivered from the hopper comes between the feeding roller 9B and the driven roller 14. Then, the cut paper detecting sensor 23A detects the leading end of the cut paper, whereby the electromagnetic clutch 10A is rendered to be a state of interruption after a predetermined time has passed, namely, a time necessary for the leading end of the cut paper to reach the position between the feeding roller 9B and the driven roller 14. Then, an instruction of starting printing operation is produced from the printing controller(-not shown). By such instruction, the control means changes the electromagnetic clutch 10B to a state of transmission to thereby rotate the feeding roller 9B, and at the same time, it excites the solenoid 16 for a predetermined time so that the driven roller 14 is brought into contact with the feeding roller 9B. Accordingly, the cut paper delivered from the hopper 3 is transferred to the transferring section 19 of the sensitized drum 18 where visible images such as characters or figures are produced at the transferring section. Then, the cut paper is passed through the transferring guide 21 and between the feed roller 9C and the pinch roller 17*a* which are paired to transfer the cut paper. Then, the cut paper is passed between the feeding roller 9D and the pinch roller 17*b* provided at the downstream side of the paired rollers 9*c*, 17*a*, the rollers 9D, 17*d* being paired in the same manner as the rollers 9C, 17*a*. Finally, the cut paper is fed to the discharge port 5*a* through the fixing device 22 where the toner powder forming an image is fixed on the paper. Then, cut paper is received in the stacker 5 as indicated by an imaginary line in FIG. 2.

Description will be made as to continuous feeding operations for the cut papers 4.

First of all, the electromagnetic clutch 10A is actuated by the control means to transmit the rotational force of the paper feeding roller 9A, whereby the cut papers are successively delivered from the hopper 3. The cut paper detecting sensor 23A detects the leading end of a cut paper, and a detection signal from the sensor 23A is stored in a first memory device(not shown). The cut paper 4 is transferred from the position of detection by the sensor 23A to the feeding roller 9B provided at a predetermined distance from the position of detection.

The electromagnetic clutch 10A is changed to a state of interruption by a detection signal stored in the first memory device so that transmission of the rotational force to the paper feeding roller 9A is interrupted. At this moment, the paper feeding roller 9A is only rotatable in the direction of feeding the cut papers.

Then, the electromagnetic clutch 10B is actuated by a signal from the control means to thereby transmit the rotational force to the feeding roller 9B so as to move the cut paper 4 by a predetermined distance which has been previously obtained and thereafter the electromagnetic clutch 10B is turned off.

During the transferring operations, the rear end of the cut paper 4 is detected by the cut paper detecting sensor 23A, and a detection signal from the sensor 23A is stored in a second memory device. After the cut paper 4 is moved by a predetermined distance from the position of detection, the electromagnetic clutch 10A is again actuated by the signal of the second memory device to thereby transmit the rotational force to the paper feeding roller 9A. Then, the paper feeding operations for the next cut paper 4 become ready. Thus, the abovementioned operations are repeatedly executed.

Now, description will be made as to the continuous paper transferring operations in a case that the continuous mode is selected.

When a continuous paper is to be used, the stacker 4 is previously turned to the vertical position. And, of course, a continuous paper 6 is fitted to the first tractor 20A at the inlet port 7 for the continuous paper.

Then, the continuous mode is selected by operating the operation panel 2 as shown in FIG. 1. By selecting the continuous mode, the electromagnetic clutches 10A, 10B for transferring the cut papers are first turned off, whereby a rotational force transmission system for transmitting a rotation force from the driving source 8 to the paper feeding roller 9A and the feeding roller 9B is disconnected.

The solenoid 16 is also deenergized. Accordingly, the driven roller 14 is maintained at a position apart from the outer circumferential surface of the feeding roller 9B by a spring(not shown) through the link 15.

In accordance with the selection of the continuous mode, the pulse motor 8 is rotated in the regular direction by the control means in the same manner as the operation by the above-mentioned cut paper transferring means. At the same time, the electromagnetic clutch 10C is changed to a state of transmission by the control means. Accordingly, the rotational force of the driving source 8 is transmitted to the first tractor 20A and the second tractor 20B through the transmission elements 11*c*, 12*e*, 13*d*, 12*f*, 12*g* and 13*e*, whereby the both tractors are rotated in synchronism with each other. Then, the continuous paper inserted in the inlet port 7 is moved inside by the first tractor 20A so as to pass through the transferring guide 21. Visible images such as characters and/or figures are produced on the continuous paper at the transferring section 19 at the sensitized drum 18 in accordance with an instruction of printing, and the toner powder is fixed on the paper by the fixing device 22 in the same manner as the cut paper. Then, the continuous paper 6 is successively delivered to the slit-like discharge port 5*a* in the stacker 5.

As described above, the paper transferring apparatus of the present invention is provided with the cut paper transferring means and the continuous paper transferring means wherein either of the two transferring means is actuated by selecting the different operating mode. Accordingly, different kinds of cut papers and the continuous paper can be treated by simply selecting the mode. Further, the paper transferring apparatus is provided with the connection/disconnection means which perform transmission and interruption of the rotational force of the driving source by a control signal on the basis of the selection of mode. Accordingly, it is possible to use a common driving source, by which reduces the manufacturing cost.

As the driving source, the pulse motor capable of regularly and reversely rotating is used, and the continuous paper detective sensor is provided at the position toward the discharge port with respect to the second tractor. In the case that when the cut paper mode is selected and when the continuous paper detecting sensor is ON, the continuous paper is reversely moved until the leading end of the continuous paper comes near the first tractor by controlling the stepping operations of the pulse motor which is reversely rotated, the cut paper can be subjected to delivering, printing and discharging operations while the continuous paper is held by the first tractor. Accordingly, the operation for setting the continuous paper to the first tractor is not always necessary at the time of switching of the operation mode to the continuous mode. Therefor a troublesome operation to attach or detach the hopper to the apparatus main body when the cut papers are to be used, can be eliminated. Further the cut papers or the continuous paper can be used at any time by switching the operation mode on the basis of an input to the control means.

We claim:

1. A paper transferring apparatus in an electrophotograph type printer having a cut paper storage hopper, which comprises:

(a) an apparatus main body having a side surface where the hopper for receiving cut papers and an inlet port for a continuous paper are provided, and an other surface opposite said side surface where a discharge port for discharging the cut papers and the continuous paper is formed, (b) a cut paper transferring means for transferring the cut papers from the hopper via a transferring section to the discharge port, said cut paper transferring means including at least one drive roller positioned adjacent the cut paper storage hopper so as to drive cut paper sheets from said cut paper storage hopper, (c) a continuous paper transferring means for transferring the continuous paper from the inlet port through the transferring section to the discharge port, the cut paper and continuous paper transferring means being independently provided in the apparatus main body, (d) a common driving source for driving both said transferring means, said common driving source comprising a reversible pulse motor driving both said cut paper transferring means and said continuous paper transferring means, (e) the cut paper transferring means having a connection/disconnection means for performing connection and disconnection of the rotational force of the driving means to the cut paper transferring means upon receiving a control signal;

(f) the continuous paper transferring means having a first tractor at the inlet port side and a second tractor behind said transferring section in a direction of paper movement, said first and second tractors being connected to the driving source through a power transmission means, and the connection/disconnection means interposed between the power transmission means and the driving source for performing connection and disconnection of the rotational force of the driving source with the first and second tractors upon receiving a control signal, and (g) a control means for selecting a cut paper mode or a continuous paper mode on the basis of an input signal and for providing the control signal to each of the connection/disconnection means on the basis of the selected mode for a paper-feeding instruction or a printing instruction.

2. The paper transferring apparatus for an electrophotograph type printer according to claim 1, wherein:

a continuous paper detecting sensor is positioned at the discharge port side with respect to second tractor; and the control means being operable in such a manner that under the condition of the selection of the cut paper mode, when the continuous paper detecting sensor is ON, the pulse motor is reversely rotated so that the continuous paper is reversely transferred by controlling the step operation of the pulse motor until the front edge of the continuous paper reaches near the first tractor, and when the continuous paper detecting sensor is OFF, the pulse motor is regularly rotated on the basis of the printing instruction.

3. The paper transferring apparatus for an electrophotograph type printer according to claim 1, wherein the cut paper transferring means comprises paper feeding rollers for delivering one by one the cut papers received in the hopper, first feeding rollers for feeding the delivered cut papers to the transferring section, second feeding rollers positioned behind the transferring section so as to feed the cut papers to the discharge port, and the connection/disconnection means which performs transmission and interruption of the rotational force of the driving, source to the paper feeding rollers and the first and second feeding rollers upon receiving a control signal.

4. The paper transferring apparatus of claim 1 wherein said connection/disconnection means comprise at least one clutch.

5. The paper transferring apparatus of claim 1 wherein each of said tractors is selectively driven by said pulse motor via a clutch.

* * * * *